US005893769A

United States Patent [19]

Lin

[11] Patent Number: 5,893,769

[45] Date of Patent: Apr. 13, 1999

[54] BULB SOCKET WITH FASTENING STRUCTURE FOR ELECTRIC CONNECTORS

[76] Inventor: Chiu-Chen Lin, P.O. Box 96-405, Taipei 10098, Taiwan

[21] Appl. No.: 08/791,159

[22] Filed: Jan. 30, 1997

Related U.S. Application Data

[63] Continuation of application No. 08/368,363, Jan. 4, 1995, abandoned.

[51] Int. Cl.[6] ..... H01R 4/50

[52] U.S. Cl. ..... 439/340; 439/419

[58] Field of Search ..... 439/340, 414, 439/419, 661–667, 659, 802, 865

[56] References Cited

U.S. PATENT DOCUMENTS

| | | | |
|---|---|---|---|
| 2,570,751 | 10/1951 | Benander | 439/419 |
| 2,620,374 | 12/1952 | Benander | 439/575 |
| 3,214,724 | 10/1965 | McIntosh | 439/419 |
| 5,121,310 | 6/1992 | Ahroni | 439/419 |

FOREIGN PATENT DOCUMENTS

| | | |
|---|---|---|
| 211327 | 8/1993 | Taiwan . |
| 214693 | 10/1993 | Taiwan . |
| 227299 | 7/1994 | Taiwan . |
| 233077 | 10/1994 | Taiwan . |

*Primary Examiner*—Hien Vu
*Attorney, Agent, or Firm*—Bacon & Thomas

[57] ABSTRACT

A bulb socket with a fastening structure for electrical contacts, which comprises a body portion and a secondary body portion to be welded together by means of a supersonic welding; inside the socket, there are screw threads for fastening a bulb. The bottom surface and one side of the body portion are furnished with two electrical contacts respectively; the electrical contacts on the side has two flat surfaces to be positioned in place with two rib plates respectively; the upper end of the electrical contact is held in place by means of a stop shoulder of the secondary body portion to prevent from pulling upwards; a resilient piece is furnished between two flat surfaces of the secondary body portion, and the resilient piece has a free end. Another electrical contact is inserted into a groove through the cover-fitting channel, and is bent into a bent plate above the bottom surface; the outer end of the bent plate is held in place by means of a positioning lug, which is horizontally positioned between the two electrical contacts to prevent the two from contact un-intentionally ( i.e., short circuited ).

5 Claims, 2 Drawing Sheets

BULB SOCKET WITH FASTENING STRUCTURE FOR ELECTRIC CONNECTORS

This application is a Continuation of application Ser. No. 08/368,363, filed Jan. 4, 1995, now abandoned.

BACKGROUND OF THE INVENTION

1. Field of the Invention

This invention relates to a bulb socket, and particularly to a bulb socket which can prevent the electrical contacts therein to be pulled out or to become shortcircuited by using a fastening structure.

2. Description of the Prior Art

In a conventional and festival decoration bulb socket, the lower buttom of the socket has a channel for mounting power-supply wires; the bottom surface of the socket is mounted with two grooves for inserting two electrical contacts. The prongs of the electrical contacts extend into the grooves; after the power-supply wires are mounted in a channel, a fastening cover is fastened in the channel, and then the prongs of the electrical contacts will pierce through the insulator of the power-supply wires respectively to fulfill electric connection. The end portions of the electrical contacts extend upwards into the socket for connecting the bulb electrodes. The flange of the electrical contact will be in contact with the bulb base; such products are manufactured in Taiwan and in China mainland.

The aforesaid bulb socket caused a short-circuit accident in the United States in 1993 upon being used by children; the short-circuit accident was resulted in the flange portion and the bent plate portion. Such accident did happen, though it has passed the UL test; as a result, the UL has re-established their new standards to test the safety of such products. In accordance with the new standards of UL, the side and center contacts shall be supported, restrained, or constructed such that when subjected to a 3 lbf (13.3 N) applied in any direction, they can not become contacted each other, and a lamp screw base causes a short circuit when a lamp is installed. The screw threads inside the socket should keep a bulb therein without being pulled out upon applied with a given force; the screw threads should not become wear-and-tear. When the socket is pressed, the copper plate should not deform and dislodge.

However, both the conventional sockets and the socket disclosed in some patents (such as Taiwan patent Nos. 82209610, 82207093, 82215955 and 82218418) not do conform to the US standards; particularly, the screw threads in the bulb socket fail to meet that standards; for instance, in Patent '418, the screw threads are made with a direct ejection method, i.e., it is impossible to pass the new test standards. Other patents, such as '610, '093, and '955, the sockets thereof are made of copper with good screw threads, but the fastening method of the socket and the base is poor, i.e., by using a reverse hook, which is unable to withstand a pulling test.

SUMMARY OF THE INVENTION

The prime object of the present invention is to provide a bulb socket with a fastening structure for electrical contacts; the bulb socket comprises a body portion and a secondary body portion to be welded together by means of a supersonic welding. The socket has screw threads therein for fastening a bulb. The bottom surface and the side of the body portion are inserted with two electrical contacts respectively; the electrical contacts at one side is held in place with two rib plates; the top of the electrical contact is held in place with a stop shoulder of the secondary body portion to prevent the contact from being pulled upwards. A resilient piece having a free end is furnished between two flat surfaces thereof. Another electrical contact is inserted through the bottom surface of the body portion, and the top end of the electrical contact is formed into a bent plate, and is pressed in place with a positioning lug, which is horizontally mounted between the two electrical contacts to prevent the two connectors from becoming shortcircuited.

Another object of the present invention is to provide a bulb socket with a fastening structure for electrical contacts, in which the secrew threads has a through channel extended to a shoulder portion of a cover-fitting hole. The screw threads are made by means of a direct ejection. Since the body portion and the secondary body portion are molded separately, much less pulling force is required in comparison with the conventional ejection method. The screw threads can be made into a complete form, and therefore the screw threads would not deform or worn upon a bulb being mounted in the socket.

Still another object of the present invention is to provide a bulb socket with a fastening structure for electrical contacts, in which a groove in the bottom surface of the body portion is to insert an electrical contact through the cover-fitting channel, and the end of the electrical contact is formed into a bent plate, of which the outer end is pressed in place with a positioning lug in the secondary body portion. A flange is furnished around the bent plate; the height of the flange is equal to or lower than the bent plate. One of the flanges is higher than the bent plate to prevent the bent plate from moving or deforming, or being pulled outside, i.e., to mount the electrical contact in place properly.

A further object of the present invention is to provide a bulb socket with a fastening structure for electrical contacts, in which the bottom surface of the body portion has a connecting block nearing a rib plate; after the body portion and the secondary body portion are welded together by means of a supersonic welding, the positioning lug and the connecting block will be welded together.

A still further object of the present invention is to provide a bulb socket with a fastening structure for electrical contacts, in which the body protion and the secondary body portion can be welded together, and then the secondary body portion has a groove for positioning the flat surface of the electrical contact; beside the groove, there is a rib plate to prevent the electrical contact from becoming bent; the upper end of the rib plate has a stop shoulder to prevent the electrical contact from moving upwards. After the electrical contact is inserted into the side groove of the body portion, both sides thereof will be unable to move out and move upwards. The electrical contact is in contact with the base of a bulb through the resilient piece without bending or dislodging.

A yet further object of the present invention is to provide a bulb socket with a fastening structure for electrical contacts, in which the bottom surface between the body protion and secondary body portion has a positioning lug to press against the outer end of the bent plate of the electrical contact, and also press against the free end of the resilient plate of another electrical contact to limit the moving space thereof so as to prevent the two electrical contacts from contact un-intentionally.

DETAILED DESCRIPTION OF THE PREFERRED EMBODIMENTS

Figure 1:
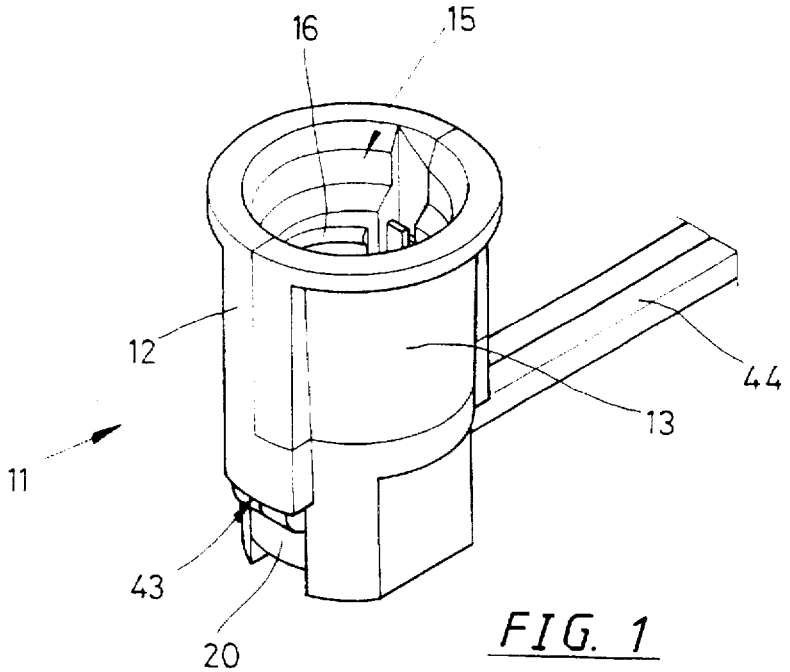
FIG. 1 is a perspective view of an embodiment of a bulb socket assembly according to the present invention.
Figure 2:
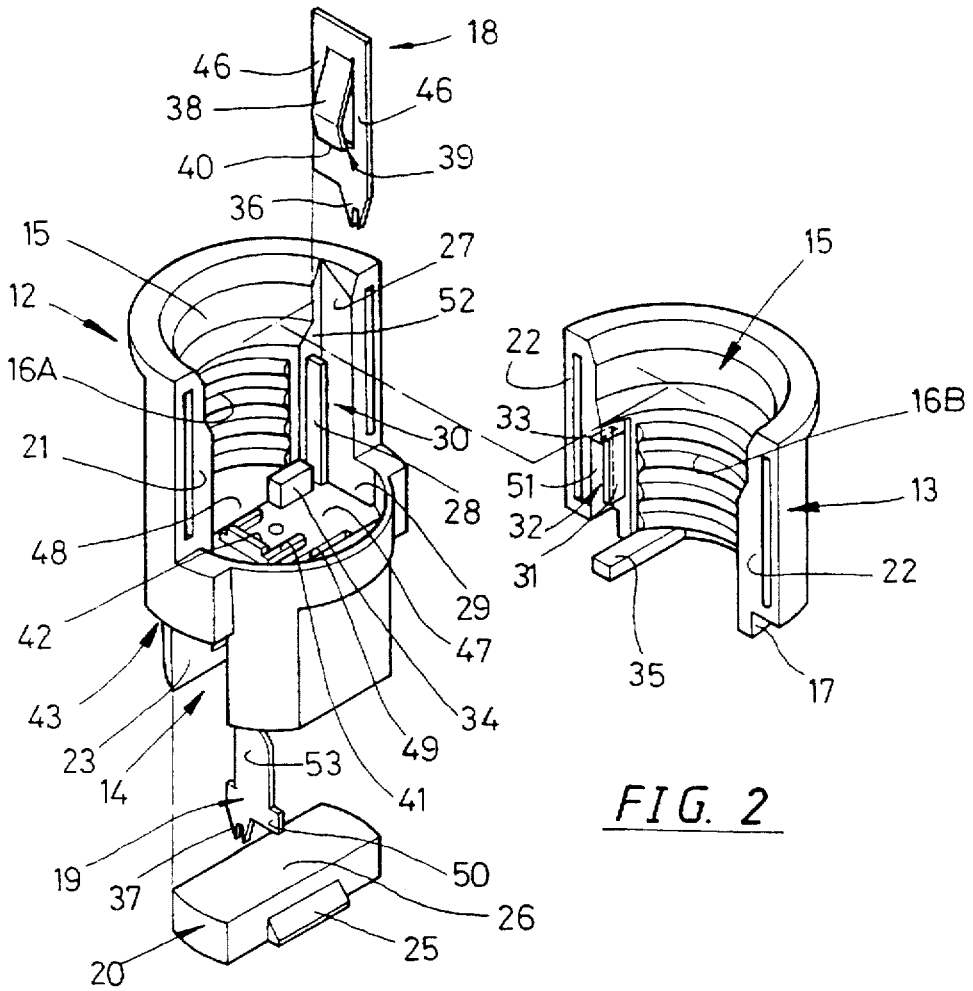
FIG. 2 is a disassembled view of the embodiment according to the present invention, showing the structure of every parts thereof.
Figure 3:
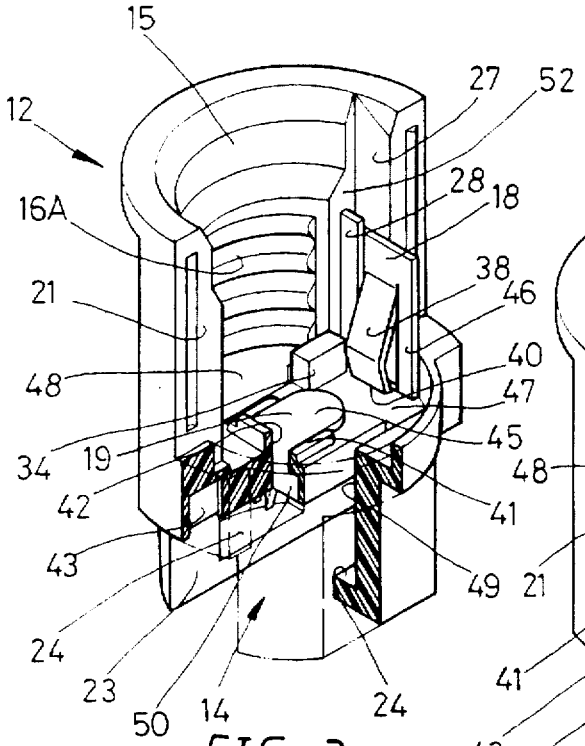
FIG. 3 is a fragmental section view of the present invention, showing the socket being connected with an electrical contact.
Figure 4:
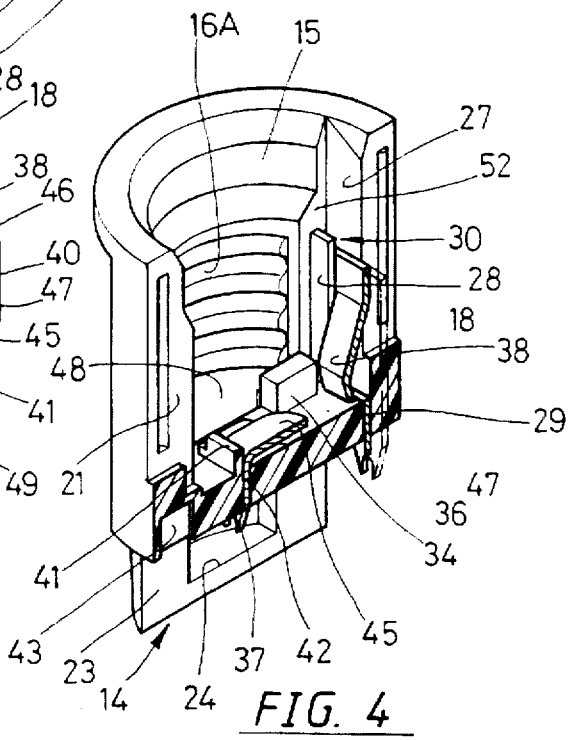
FIG. 4 is a fragmental section view of the present invention, showing the socket being connected with another electrical contact.

This invention provides a bulb socket with a fastening structure for electrical contacts. As shown in FIGS. 1 and 2, the bulb socket assembly 11 has a body portion 12, in which a bottom surface 47 has a groove 29 for inserting an electrical contacts 18. The center of the bottom surface 47 also has a groove 42 for inserting an electrical contact. After the two electrical contacts are inserted in place, the body portion 12 and the secondary body portion 13 are melted and connected together by using supersonic welding. The lower end of the body portion 12 has a cover-fitting channel 14 with an inserting hole 43 at one end thereof for receiving a pair of power-supply wires 44; the wires 44 are mounted in the cover-fitting channel 14 between the two wall surfaces 23. The cover-fitting channel 14 is to be covered with a fastening cover 20. Two electrical contacts 18 and 19 have two prongs 36 and 37 respectively, which will pierce the two power-supply wires 44 respectively in the cover-fitting channel 14 to fulfil electrical connection. In the opening end 15 of the bulb socket assembly 11, a plurality of screw threads 16 are provided for mounting a bulb.

Figure 5:
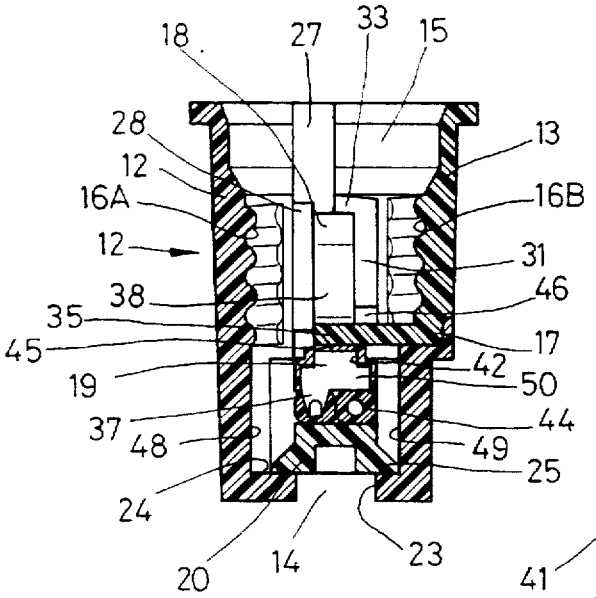
FIG. 5 is a sectional view of the present invention, showing the assembled relation between the body portion and the secondary body portion thereof.
Figure 6:
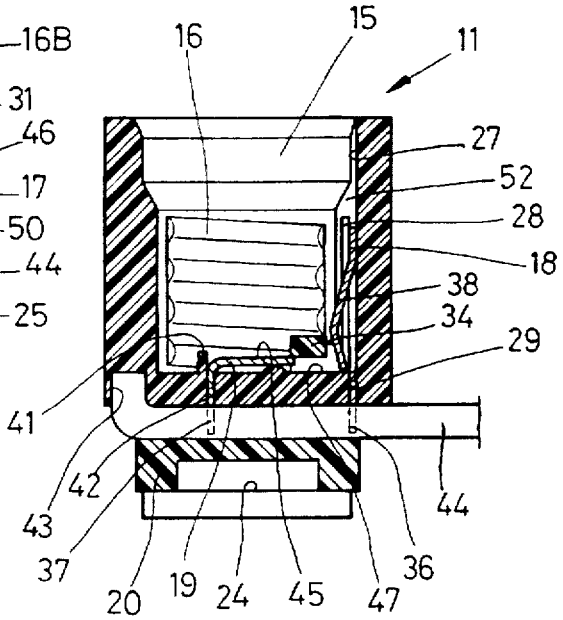
FIG. 6 is a sectional view of the present invention, showing the assembled relation between the two electrical contact.

As shown in FIGS. 2 and 5, the bottom surface 47 of the body portion 12 has an opening space for mounting the secondary body portion 13 so as to form a complete bulb socket assembly 11. Between the body portion 12 and the secondary body portion 13, there are wide welding surfaces 21 and 22 and welding flange 17, which are referred to as supersonic welding surfaces. In the opening end 15 of the body portion 12, there are a plurality of screwthreads 16A for mounting a bulb. Below the screwthreads 16A, there is a through hole 48 which extends downwardly to a shoulder portion 24 of the wall surface 23 in the cover-fitting channel 14; located diametrically opposite to the through hole 49, there is another through channel 49 also extended to the shoulder portion 24. The outside of the cover-fitting channel 14 has an inserting hole 43 for receiving the ends of a pair of power-supply wires 44 after the wires 44 passing through the cover-fitting channel 14. After the fastening cover 20 is inserted in place, the lugs 25 on both sides of the cover 20 will be fastened on the shoulder portions 24 on both sides of the cover-fitting channel 14 to prevent the power-supply wires 44 from loosening.

Before a pair of power-supply wires 44 being put in the cover-fitting channel 14 under the body portion 12, the end of the wires 44 has to be cut into an small opening to facilitate the wires to be inserted into the inserting holes 43 respectively; then, put the wires 44 into the cover-fitting channnel 14. A mid-section of the wires 44 may also be put into the cover-fitting channel 14. After the power-supply wires 44 are put in the cover-fitting channel 14, the two wires 44 will be in close contact with the prongs of the two electrical contacts 18 and 19 respectively. As soon as the inner surface 26 of the fastening cover 20 is pressed to the wires 44, the prongs of the two electrical contacts 18 and 19 will pierce through the insulator of the wires 44 respectively, and then the two lugs 25 on both sides of the fastening cover 20 will be fitted to the shoulder portions 24 of the two wall surfaces 23 of the cover-fitting channel 14; then, the prongs of the two electrical contacts 18 and 19 will pierce the insulator of the wires 44 to fulfil electric contact respectively.

Referring to FIGS. 2 to 6, the inside of the opening end 15 of the body portion 12 has screw threads 16A, which extend near the through hole 48; the hole 48 extends to the shoulder portion 24 of the wall surface 23 in the cover-fitting channel 14. The screw threads 16 is made and formed with a direct ejection method. The body portion 12 and the secondary body portion 13 are molded separately; the screw threads 16 in the body portion 12 require much less pulling force during ejection process than the conventional ring-shaped screw threads; therefore, the screw threads 16 can be formed into a complete shape so as to fit with the screw threads in the secondary body portion 13, and to facilitate mounting a bulb therein without deformation and wear.

The body portion 12, has opposite vertical wall surfaces respectively, and each of the wall surfaces 27 is located near a welding surface 21. One of the wall surfaces 27 extends from the opening end 15 to the bottom surface 47, and extends continuously to a groove 29 for receiving the electrical contacts 18, of which the prong 36 extends into the cover-fitting channel 14. A shoulder portion 52 between the wall surface 27 and the screwthreads 16A has a vertical rib plate 28, which and the wall surface 27 forms a groove 30 for mounting the electrical contact 18 to insert into a groove 29 beside the bottom surface 47.

The portion of the electrical contact 18 has two flat surfaces 46 on both sides, while the central part thereof has a resilient piece 38; the lower end of the electrical contacts 18 has prongs 36. Three sides of the resilient piece 38 are not connected with the electrical contact 18, i.e., the lower end of the resilient piece 38 is an opening end 39. After the electrical contact 18 is inserted into the groove 29, the flat surface 46 of the electrical contact 18 will be inserted into a groove 30 between the wall surface 27 and the rib plate 28. The stop side 40 of the opening end 39 of the resilient piece 38 is set on the bottom surface 47 to prevent the electrical contact 18 from going down further; the resilient piece 38 extends out at a suitable height to form into an electric connection surface.

The center of the bottom surface 47 in the body portion 12 has a groove 42 for receiving the conductor surface 53 of the electrical contact 19 through the cover-fitting channel 14. The groove 42 has a side-groove to prevent the fastening lug 50 of the electrical contact 19 from moving upwards; the prongs 37 of the electrical contact 19 is to be set in the cover-fitting channel 14 under the body portion. The conductor surface 53 in the groove 42 has a bent plate 45 facing the wall surface 27; the bent portion of the conductor surface 53 is to contact with the center electrode of a bulb. Behind the bent plate 45, there is a flange 41 arounnd two sides of the bent plate 45; the height of the flange 41 is slightly higher than that of the bent plate 45. After the body portion 12 and the secondary body portion 13 are assembled and welded together, the positioning lug 35 of the secondary body portion 13 will press the outer end of the bent plate 45 to prevent the conductor surface 53 from moving or deforming.

Between the rib plate 28 and the flange 41 on the bottom surface 47, there is a connecting block 34, which is to be welded together with the positioning lug 35 of the secondary body portion 13. Inside the opening end 15 of the secondary body portion 13, there are screw threads 16B, which would not deform or wear upon being fastened together with a bulb, i.e., able to withstand a given pulling force test. Both sides of the screw threads 16B are furnished with two vertical wall surfaces respectively. A welding surface 22 nearing the wall surface 27 has an inner wall surface 51, and as soon as the body portion 12 and the secondary body portion 13 are welded together, the two wall surfaces 51 and 27 are welded together as a plane. The wall surface 51 of the secondary body portion 13 has a stop shoulder 33. The outer edge of the screw threads 16B has a rib plate 31. A groove 32 is formed by means of the wall surface 51 and the rib plate 31. After the body portion 12 and the secondary body portion 13 are assembled together, the electrical contact 18 has already been inserted into the groove 29 in advance. The groove 32 of the secondary body portion 13 is guided with the flat surface 46 of the electrical contact 18 so as to have the flat surface inserted between the wall surface 51 and the rib plate 31. After the body portion 12 and the secondary body portion 13 are welded together, the rib plate 31 will be set on one side of the flat surface 46 of the electrical contact 18 so as to prevent the electrical contact 18 from moving; the wall surface 51 of the groove 32 and the stop shoulder 33 of the rib plate 31 press against the flat surface 46 of the side of the electrical contact 18 to prevent the electrical contact 18 from moving. The electrical contact 18 can only make electrical contact with the bulb base through the resilient piece 38.

The lower end of the rib plate 31 in the secondary body portion 13 has a positioning lug 35 extended out horizontally; after the body portion 12 and the secondary body portion 13 are assembled together, the positioning lug 35 will be set on the bottom surface 47 of the body portion 12; the lower edge of the positioning lug 35 will press against the outer end of the bent plate 45 of the electrical contact 19, while the end of the lug 35 is in contact with the connecting block 34, and they are welded together by means of a supersonic welding. After the positioning lug 35 and the connecting block 34 are welded together, the bent plate 45 will be set in place without moving.

After the body portion 12 and the secondary body portion 13 are welded into a bulb socket assembly 11, the positioning lug 35 will limit the conductor surface 53 in the bottom surface 47 to move so as to let the conductor surface 53 contact with the center electrode of a bulb. The positioning lug 35 is in contact with the lower end of the electrical contact 18, i.e., being mounted on outer side of the opening end 39 of the resilient piece 38 to prevent the resilient piece 38 from moving outwards so as to have the screw threads 16 of a bulb and the resilient piece 38 maintained in close contact.

The two electrical contact s 18 and 19 are inserted into two grooves 29 and 42 on the bottom surface 47 respectively. After the body portion 12 and the secondary body portion 13 are welded together, a stop shoulder 33 on the rib plates 28 and 31 for limiting the electrical contact 18 to move will have the end of the bent plate 45 of the electrical contact 19 pressed on the positioning lug 35 to isolate the two electrical contacts 18 and 19 from each other without loosing, moving or shortcircuited.

The aforesaid description has delinated the features and structure of the embodiment according to the present invention, including some novel improvements which are never shown in the prior art of the kind.

I claim:

1. A bulb socket with a fastening structure for electrical contacts comprising:

a first body portion having bottom surface and an open space for mounting a secondary body portion, a first end of said first body having a first threaded portion, a through hole located below said first threaded portion, one side and a center of said bottom surface of said first body portion each having a groove for mounting electrical contacts respectively, a first one of said grooves extending along a wall surface, a second one of said grooves formed with a rib plate in said bottom surface, said first body portion forming a cover fitting channel configured to accommodate electrical wires therein;

a secondary body portion attached to said first body portion, said secondary body portion having a second threaded portion located opposite to said first threaded portion in said first body portion, both said first body portion and said secondary body portion having welding surfaces respectively so as to weld said two body portions together; said secondary body portion having a positioning lug extending horizontally under said rib plate and across said bottom surface of said first body portion;

a first electrical contact mounted in said first one of said grooves, said first electrical contact having two flat surfaces on opposite sides thereof and having a resilient piece between said two flat surfaces, said first contact having first prongs at a lower end thereof extending into said cover-fitting channel;

a second electrical contact mounted in said center of said bottom surface, having a fastening lug at one side thereof, second prongs at a lower end thereof and an upper part of said second electrical contact extending through said bottom surfaces to form a bent plate, which is held in place by said positioning lug of said secondary body portion; and, a fastening cover attached to said first body portion to cover said fitting channel for pressing electrical wires in said cover-fitting channel under said first body portion such that said first and second prongs of said electrical contacts pierce through an insulator of said wires after said fastening cover is mounted in said cover-fitting channel.

2. The bulb socket as claimed in claim 1, wherein said bottom surface of said first body portion has a space for receiving said secondary body portion, each body portion having mutually contacting welding surfaces to be welded together by a supersonic welding process.

3. The bulb socket as claimed in claim 1, wherein said secondary body portion has a through hole below said second threaded portion thereof and wherein said first body portion has two shoulder portions formed into said cover-fitting channel for attaching the fastening cover therein.

4. The bulb socket as claimed in claim 1, further comprising a flange furnished on said bottom surface around said bent plate the height of said flange being equal to that of said bent plate.

5. The bulb socket as claimed in claim 1, further comprising a connecting block on said first body portion in contact with the positioning lug of said secondary body portion.

* * * * *